United States Patent [19]

Yamashita et al.

[11] Patent Number: 5,065,198

[45] Date of Patent: Nov. 12, 1991

[54] COPYING APPARATUS HAVING MEANS FOR INHIBITING MANUAL SETTING OF PAPER SIZE AND MAGNIFICATION WHEN THE AUTOMATIC PAPER SELECTIVE MODE AND AUTOMATIC MAGNIFICATION SELECTION MODE ARE SET

[75] Inventors: Toshiyuki Yamashita; Masazumi Ito; Kadotaro Nishimori, all of Osaka, Japan

[73] Assignee: Minolta Camera Kabushiki Kaisha, Osaka, Japan

[21] Appl. No.: 400,789

[22] Filed: Aug. 30, 1989

[30] Foreign Application Priority Data

Aug. 31, 1988 [JP] Japan ..... 63-219182
Aug. 31, 1988 [JP] Japan ..... 63-219183
Aug. 31, 1988 [JP] Japan ..... 63-219184

[51] Int. Cl.[5] ..... G03G 21/00

[52] U.S. Cl. ..... 355/313; 355/243; 355/311

[58] Field of Search ..... 355/313, 243, 311, 55, 355/314, 228, 232, 204, 206

[56] References Cited

U.S. PATENT DOCUMENTS 3,989,371 12/1976 Valentine ..... 355/311 X
4,011,012 3/1977 Kawai ..... 355/55
4,076,417 2/1978 Hayashi et al. ..... 355/243 X
4,386,769 6/1983 Ito et al. .
4,620,782 12/1986 Kurando et al. ..... 355/311
4,647,188 3/1987 Komiya et al. .
4,657,376 4/1987 Ide .
4,723,148 2/1988 Hamakawa .
4,731,637 3/1988 Acquaviva et al. .
4,763,889 8/1988 Dei et al. ..... 355/313 X

*Primary Examiner*—A. T. Grimley
*Assistant Examiner*—Thn Dang
*Attorney, Agent, or Firm*—Burns, Doane, Swecker & Mathis

[57] ABSTRACT

A copying machine having the APS mode for automatically selecting size of copy paper based on the size of the original and the copying magnification includes an APS mode setting switch, copy paper selecting switch for manually selecting the size of the copy paper and a controller for controlling the copying machine such that the operation of the copy paper selecting switch is inhibited when the APS mode is set. When the APS mode is set in the copying machine, the copy paper having the size selected by the copy paper selecting switch is inhibited even if the user operates the copy paper selection switch, due to the operation of the controller.

14 Claims, 16 Drawing Sheets

COPYING APPARATUS HAVING MEANS FOR INHIBITING MANUAL SETTING OF PAPER SIZE AND MAGNIFICATION WHEN THE AUTOMATIC PAPER SELECTIVE MODE AND AUTOMATIC MAGNIFICATION SELECTION MODE ARE SET

BACKGROUND OF THE INVENTION

1. Field of the Invention

The present invention relates to a copying machine and, more specifically, to a copying machine in which either an APS mode (Automatic Paper Select: a mode in which copying paper is automatically selected based on the size of the original and the copying magnification rate) or an AMS mode (Automatic Magnification Select: a mode in which copying magnification is automatically selected based on the size of the original and the size of the copy paper) can be set.

2. Description of the Related Art

A copying machine has been proposed in which the APS mode, that is, a mode for automatically selecting copy paper of a proper size based on the detected size of an original and the set magnification, can be set. When the APS mode is set and a key input is done for selecting copy paper before inputting the print key in such a copying machine, the selection of the copy paper by this key input is possible. However, when the print key is operated in this state, a sheet of copy paper whose size is different from the selected copy paper may possibly be selected for copying due to the APS mode.

Another copying machine has been proposed (U.S. Pat. No. 4,647,188) which is adapted to cancel the APS mode when the key input is done for selecting the copy paper under the APS mode.

Now, as described above, the APS mode is for automatically selecting the copy paper of the appropriate size. Therefore, when the APS mode is set, it is not necessary to make the key input valid for selecting copy paper before the input of print key. However, in conventional copying machines, the key input for selecting the copy paper is taken valid before the input of the print key under the APS mode. Consequently, miss copies have been generated due to the erroneous setting by the user.

Meanwhile, a copying machine has been proposed in which the AMS mode for automatically selecting proper magnification based on the detected size of the original and the selected size of the copy paper for copying can be set. In such a copying machine, when a key input is done for selecting magnification before inputting the print key under the AMS mode, the selection of the magnification by this key input is possible. However, when the print key is inputted in this state, the AMS mode is operated, so that a magnification rate which is different from the selected magnification may possibly be selected.

A copying machine has been proposed which is adapted to cancel the AMS mode when a key input is done for selecting magnification under the AMS mode (U.S. Pat No. 4,647,188).

Now, as described above, the AMS mode is for automatically selecting proper magnification rate, so that it is not necessary to make the key input valid for selecting the magnification before the input of the print key. However, in the conventional copying machine, the key input for selecting magnification rate before inputting the print key is valid even under the AMS mode.

Therefore, miss copies may possibly be generated due to the erroneous setting by the user.

Meanwhile, sometimes the user attaches a paper feeding cassette to a paper feeding inlet of a copying machine in which the APS mode can be set, before the input of the print key. In such case, the user intends to make copies on the sheets of copy paper of the size contained in the attached paper feeding cassette. However, conventionally, the APS mode is still maintained after the attachment of the paper feeding cassette, so that copies of the desired size cannot be provided. Consequently, miss copies may be generated, as the intention of the user is different from the result of the APS mode operation.

SUMMARY OF THE INVENTION

Therefore, one object of the present invention is to prevent erroneous operation by the user of a copying machine in which the APS mode can be set.

Another object of the present invention is to prevent erroneous operation by the user of a copying machine in which the AMS mode can be set.

A further object of the present invention is to surely carry out copying operation on the copy paper of the desired size in a copying machine in which the APS mode can be set.

The above described objects of the present invention can be attained by a copying machine for copying images of an original onto a sheet of paper, comprising: an automatic paper setting apparatus for setting a mode (APS mode) for automatically selecting paper size based on the size of an original and the magnification rate, a manual paper setting apparatus for setting manually the paper size, and an inhibiting apparatus for inhibiting setting of the paper size by the manual paper setting apparatus when automatic paper selecting mode is set.

Since the copying machine of the present invention comprises the above described components, manual paper setting is inhibited when the automatic paper selecting mode is set in the copying machine. Therefore, manual paper setting cannot be carried out unless the automatic paper selecting mode is cancelled. Consequently, miss copies caused by erroneous operation by the user can be prevented in the copying machine in which the APS mode can be set.

In accordance with another aspect of the present invention, the copying machine for copying images of an original onto a sheet of paper comprises: an automatic magnification setting apparatus for setting a mode for automatically selecting the magnification rate based on the size of the original and the size of the paper, a manual magnification setting apparatus for manually setting the magnification rate, and an inhibiting apparatus for inhibiting manual setting of the magnification rate by the manual, magnification selecting apparatus when the automatic magnification rate selecting mode is set in the copying machine.

Since the copying machine of the present invention comprises the above described components, manual setting of the magnification rate is inhibited when the automatic magnification selecting mode is set in the copying machine. Therefore, manual setting of the magnification rate cannot be carried out unless the automatic magnification selecting mode is cancelled. Consequently, erroneous operation by the user can be prevented in a copying machine in which the AMS mode can be set.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

I. First Embodiment

The present invention will be hereinafter described with reference to the figures showing embodiments thereof.

Figure 1:
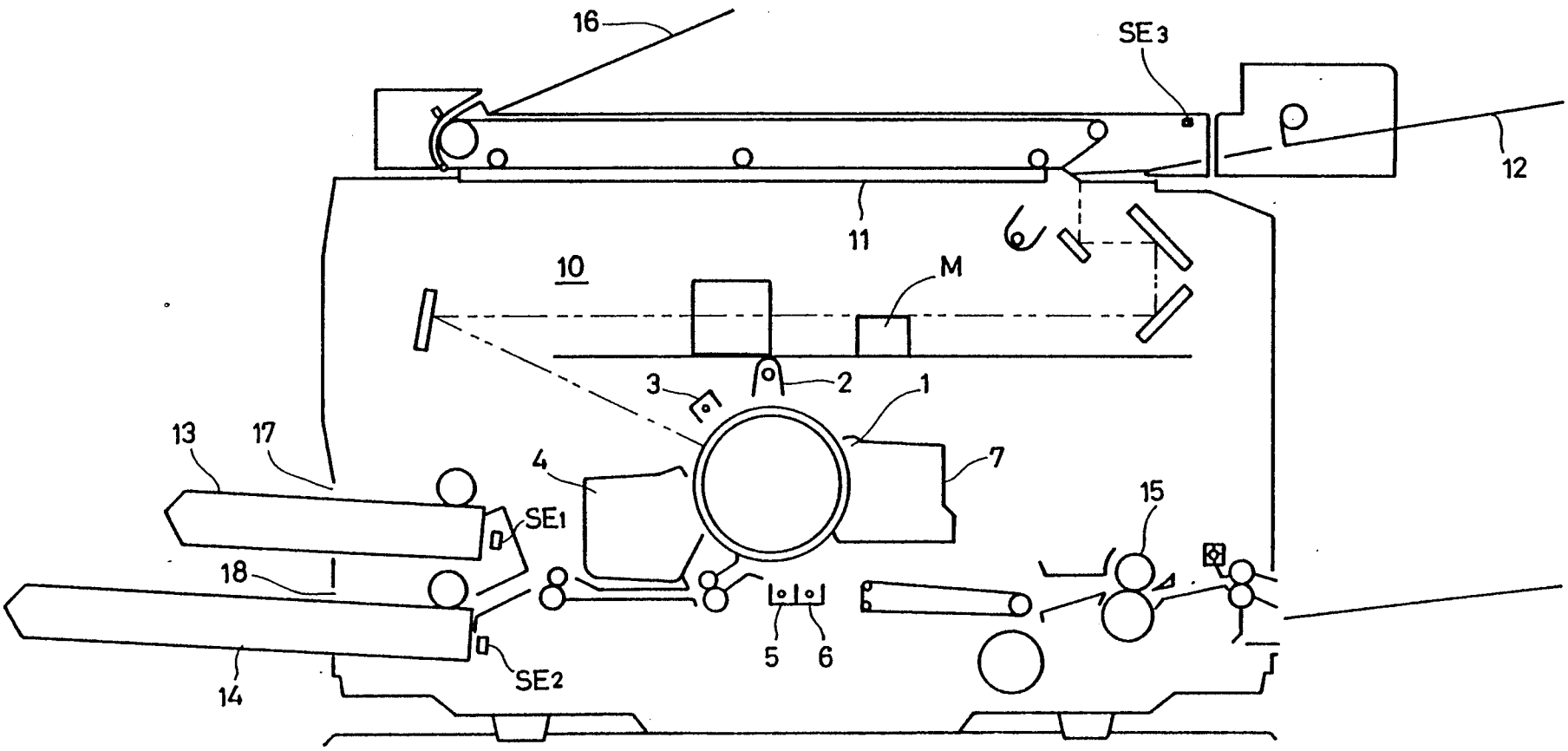
FIG. 1 is a cross sectional view of a main portion of the copying machine in accordance with the present invention.

Referring to FIG. 1, a copying machine to which the present invention is applied comprises a photoreceptor drum 1 provided rotatable in the counter clockwise direction approximately at the center. An eraser lamp 2, a corona charger 3, a developing apparatus 4, a transfer charger 5, a separating charger 6, a cleaning apparatus 7, an optical system 10 and a fixing apparatus 15 are arranged around the photoreceptor drum. These components are well known. Above the photoreceptor drum 1, a magnification changing motor M for moving the optical system 10 to realize copying at the set magnification rate is provided.

An original tray 12 for placing the original to be copied is provided on the copying machine. The originals placed on the original tray 12 are transferred one by one to a platen glass 11, optically scanned by the optical system 10 to be discharged onto a discharging tray 16. An original size detecting sensor $SE_3$ for detecting the size of the original is provided along the conveying path from the original tray 12 to the platen glass 11. The original size detecting sensor $SE_3$ detects the length of the original being conveyed to detect the original size such as A4L, A4W (L represents lengthwise, W represents widthwise).

Paper feeding inlets 17 and 18 are formed at an upper and lower portions of a lower side of the coping machine. An upper paper feeding cassette 13 is attached to the upper paper feeding inlet 17 while a lower paper feeding cassette 14 is attached to the lower paper feeding inlet 18. Codes representing the size and the direction of the paper contained in the cassette are applied on the respective paper feeding cassettes 13 and 14. Two cassette size detecting sensors $SE_1$ and $SE_2$ for detecting the codes are provided at the respective paper feeding inlets 17 and 18. By detecting the codes applied on the respective paper feeding cassettes 13 and 14 by the cassette size detecting sensors $SE_1$ and $SE_2$, the size of the copy paper contained in the cassettes attached to the data feeding inlet 17 or 18 can be detected.

Figure 2:
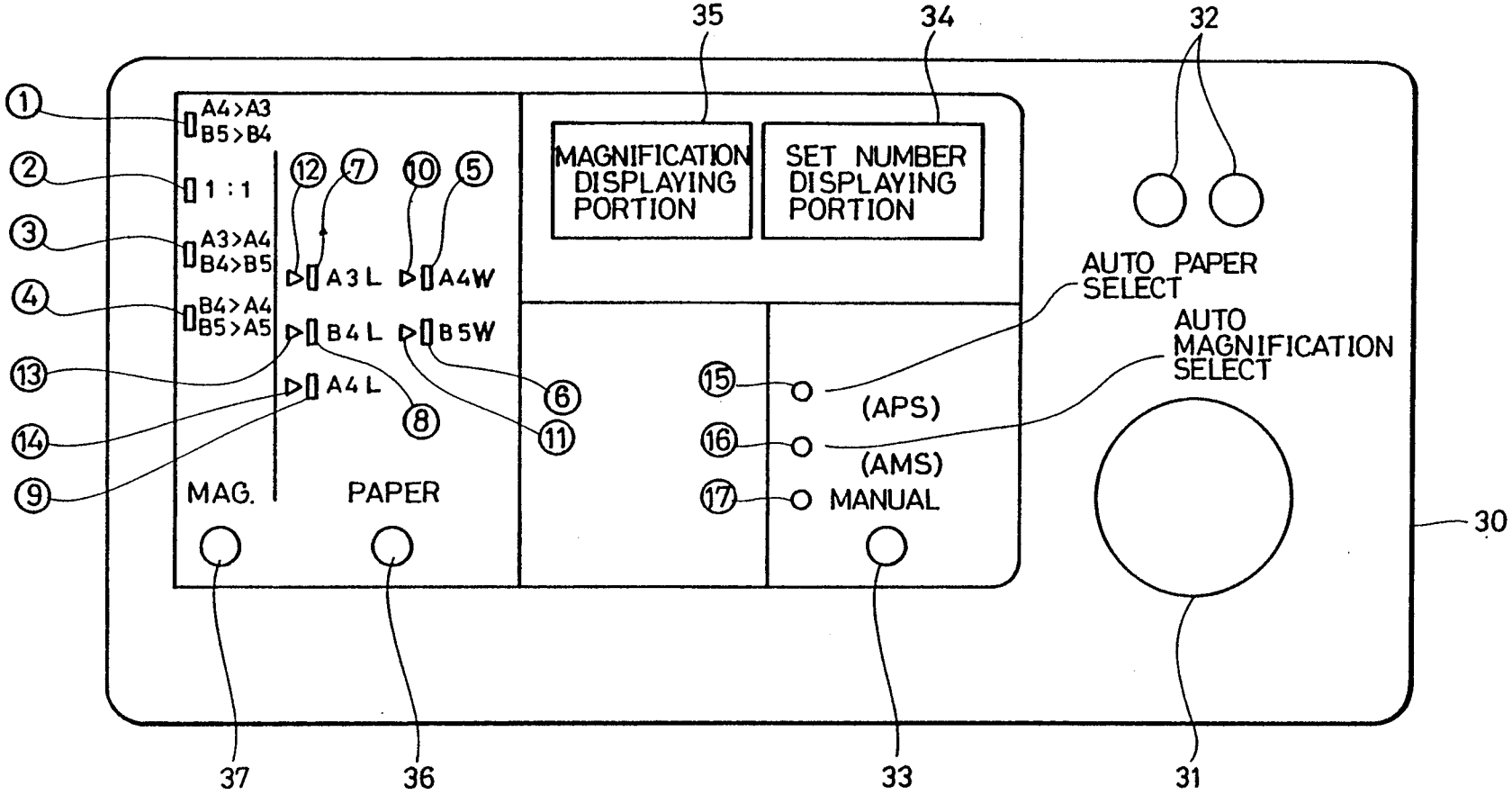
FIG. 2 is a plan view of an operation panel of the copying machine in accordance with the present invention.

Referring to FIG. 2, the operation panel 30 of the copying machine will be described. Only the portions pertinent to the present invention are shown in FIG. 2.

On the operation panel 30 arranged are a print key 31 for designating start of the copying operation, a key 32 for setting the number of copies, a set number displaying portion 34 for displaying the set number of copies in response to the input through the number setting key 32, a mode selection key 33 for selecting copying mode, a paper selection key 36 for setting copy paper, a magnification selection key 37 for selecting copying magnification, and a magnification displaying portion 35 for displaying the copying magnification in response to the input through the magnification selecting key 37. The copy mode selection key 33 is to select the APS mode, AMS mode or a manual mode (in which the copy paper and the magnification rate are manually selected). LEDs 15L (APS mode), 16L (AMS mode), 17L (manual mode), for monitoring are turned on corresponding to the mode selected through the mode selection key 33. The paper selection key 36 selects the copy paper having the size of A4W, B5W, A3L, B4L, or A4L. LEDs for monitoring, that is, 10L (A4W), 11L (B5W), 12L (A3L), 13L (B4L), and 14L (A4L) are turned on corresponding to the selected size of the copy paper. The LEDs 5L (A4W), 6L (B5W), 7L (A3L), 8L (B4L) and 9L (A4L) are turned on corresponding to the size of the paper contained in the paper feeding cassettes 13 and 14 attached to the paper feeding inlets 17 and 18. A desired copying magnification is selected by the magnification selection key 37 out of the magnification rates of A4->A3; B5>B4 (1.414), 1:1 (1), A3>A4; B4>B5 (0.707), B4>A4; B5>A5 (0.817).

Figure 3:
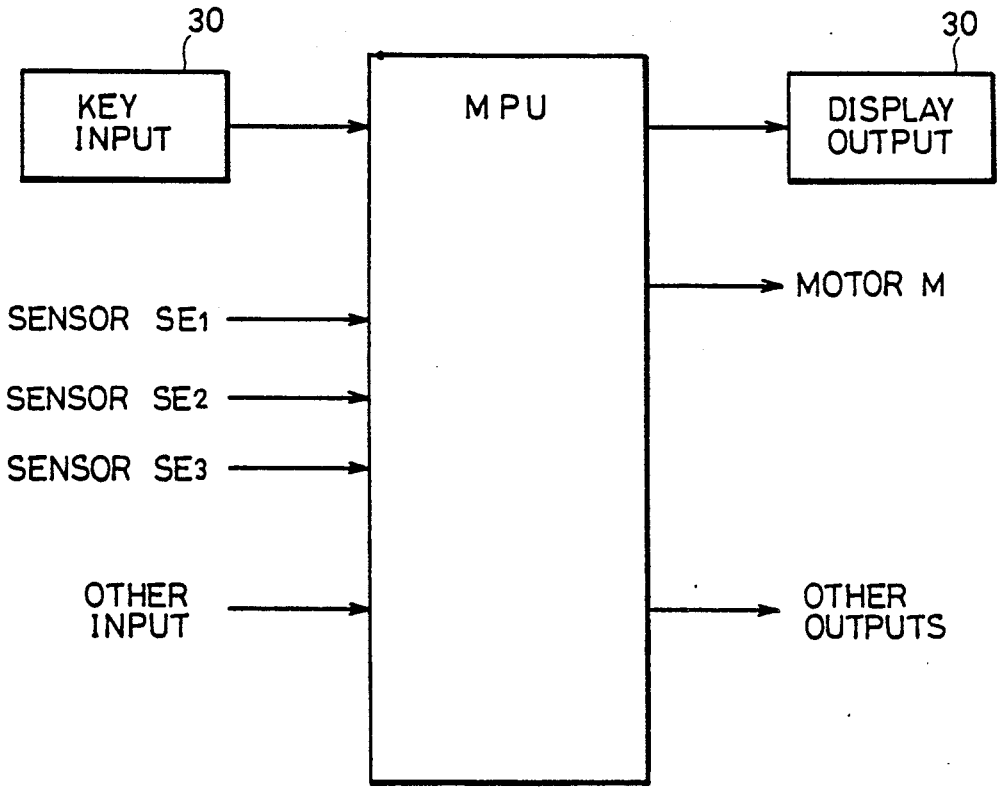
FIG. 3 is a block diagram showing a circuit controlling the copying machine.

FIG. 3 shows a circuit controlling the copying machine. Key input signals from the operation panel 30 and detection signals from respective sensors $SE_1$, $SE_2$ and $SE_3$ are inputted to a microprocessor unit MPU. In addition, signals from a jam detection switch and the like are also inputted.

Meanwhile, signals controlling displays on the operation panel and signals for controlling the magnification changing motor M are inputted from the microprocessor MPU. Image forming means such as the eraser lamp 2 and the corona charger 3 are also controlled by the microprocessor MPU.

Figure 4:
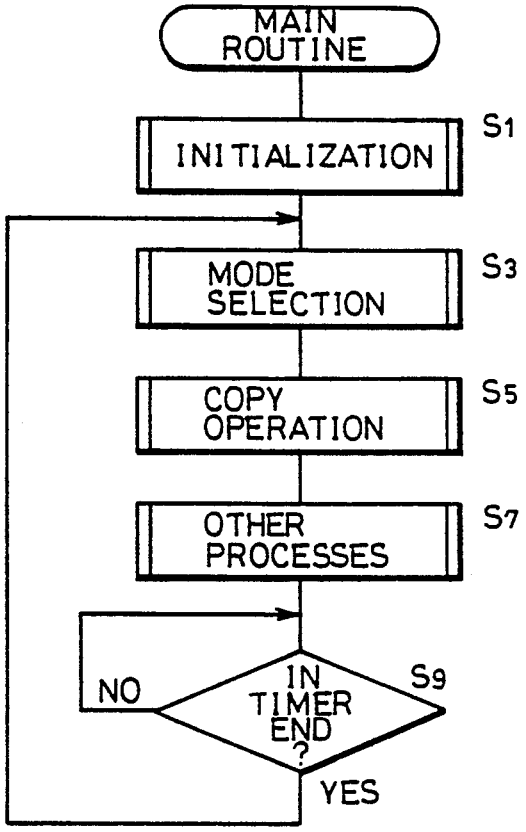
FIG. 4 is a flow chart showing a main routine of the operation of the copying machine in accordance with the present invention.

The flow of the main routine of the copying machine will be described with reference to FIG. 4. In the step S1, various timers, flags and displaying portions used in the following subroutines are initialized, and the copying mode is selected (step S3). The copying operation is carried out (step S5), processes subsequent to the copying operation are carried out (step S7) and, thereafter, at the end of operation of an internal timer (step S9) the flow returns to the step S3 to select the mode again.

Figure 5:
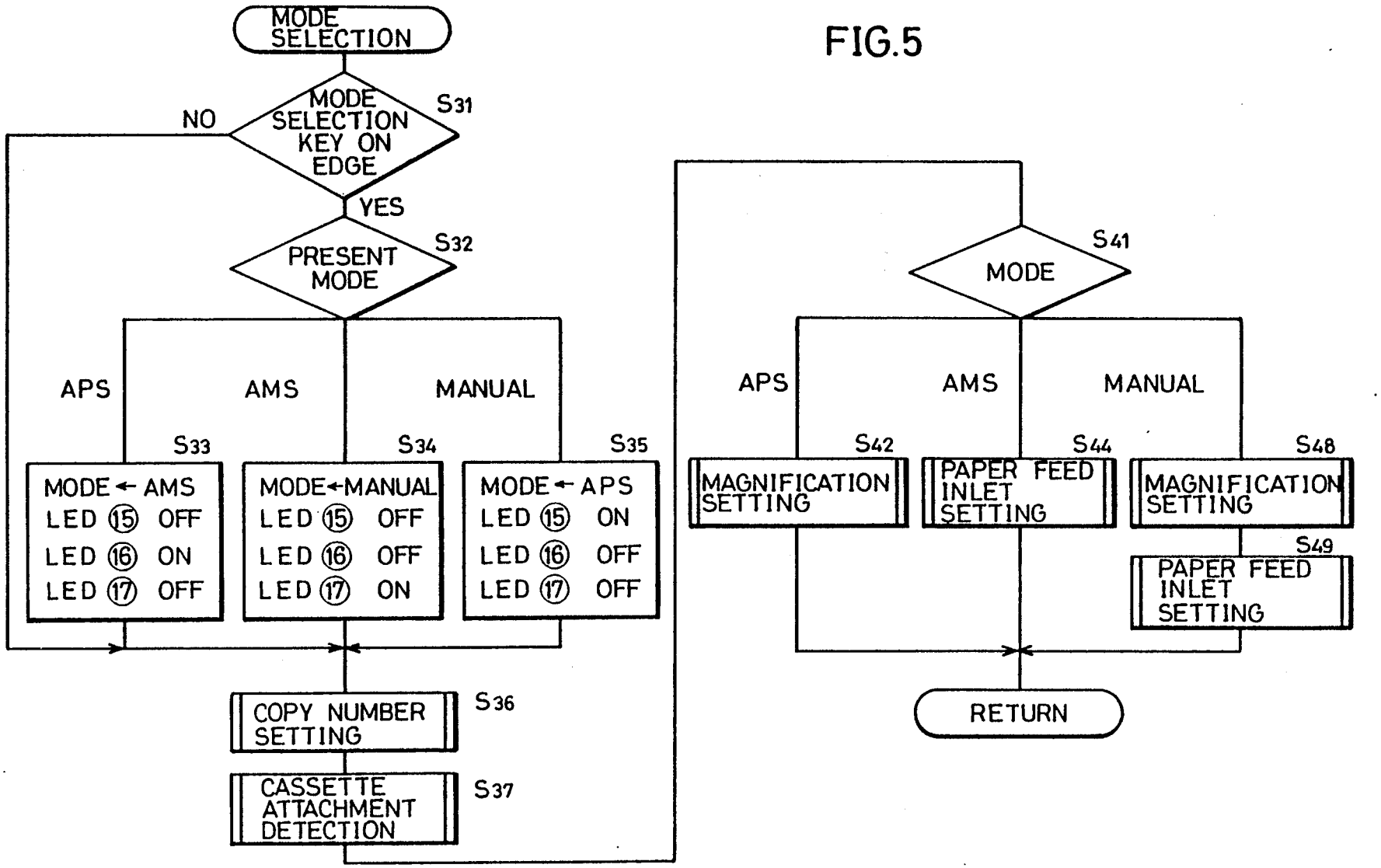
FIGS. 5 to 11 are flowcharts showing a first embodiment of subroutines constituting the main routine of FIG. 4.

Referring to FIG. 5, the content of a mode selection routine (step S3) shown in FIG. 4 will be described.

In the following paragraphs, the term "on-edge" is defined as change in status where a switch, a sensor, a signal or the like changes from the off status to the on status. In contrast, the term "off-edge" represents change in status where a switch, a sensor, a signal or the like changes from the on status to the off status.

First, in the step S31, whether or not there is an ON edge of the mode selection key 33 is determined. If the ON edge is determined (step S31; YES), then which one of the APS mode, AMS mode and the manual mode is selected at present is checked (step S32). When the present mode is the APS mode, the mode is switched to the AMS mode. Only the LED 16L is turned on (step S33). If the present mode is the AMS mode, then the mode is switched to the manual mode. Only the LED 17L is turned on (step S35). If the present mode is the manual mode, then the mode is switched to the APS mode and only the LED 15L is turned on (step S35). In this manner, the mode is changed every time the mode selection key 33 is pressed. If the ON edge of the mode selection key 33 is not detected (step S31; YES), then the mode is maintained as it is.

Thereafter, the number of copies is set by the number setting key 32 (step S36), and which cassettes containing the copy paper are attached to the respective paper feeding inlets 17 and 18 are detected (step S37). The mode is determined again (step S41). If it is the APS mode, then the copying magnification is set (step S42). When it is the AMS mode, which one of the paper feeding inlet is to be selected is determined (step S44), and when it is the manual mode, then the copying magnification is set (step S48) and thereafter the paper feeding inlet is set (step S49).

As described above, in the copying machine of the present invention, the mode of the copying machine is determined at first (step S41). If the APS mode is set, the paper feeding inlet cannot be set. If it is the AMS mode, the setting of the magnification cannot be carried out. Therefore, when the APS mode is set, the key input for selecting the paper feeding inlet before the input of the print key becomes invalid, while under the AMS mode, the key input for selecting the magnification rate becomes invalid. Therefore, miss copies derived from erroneous operation by the user can be prevented.

Figure 6A:
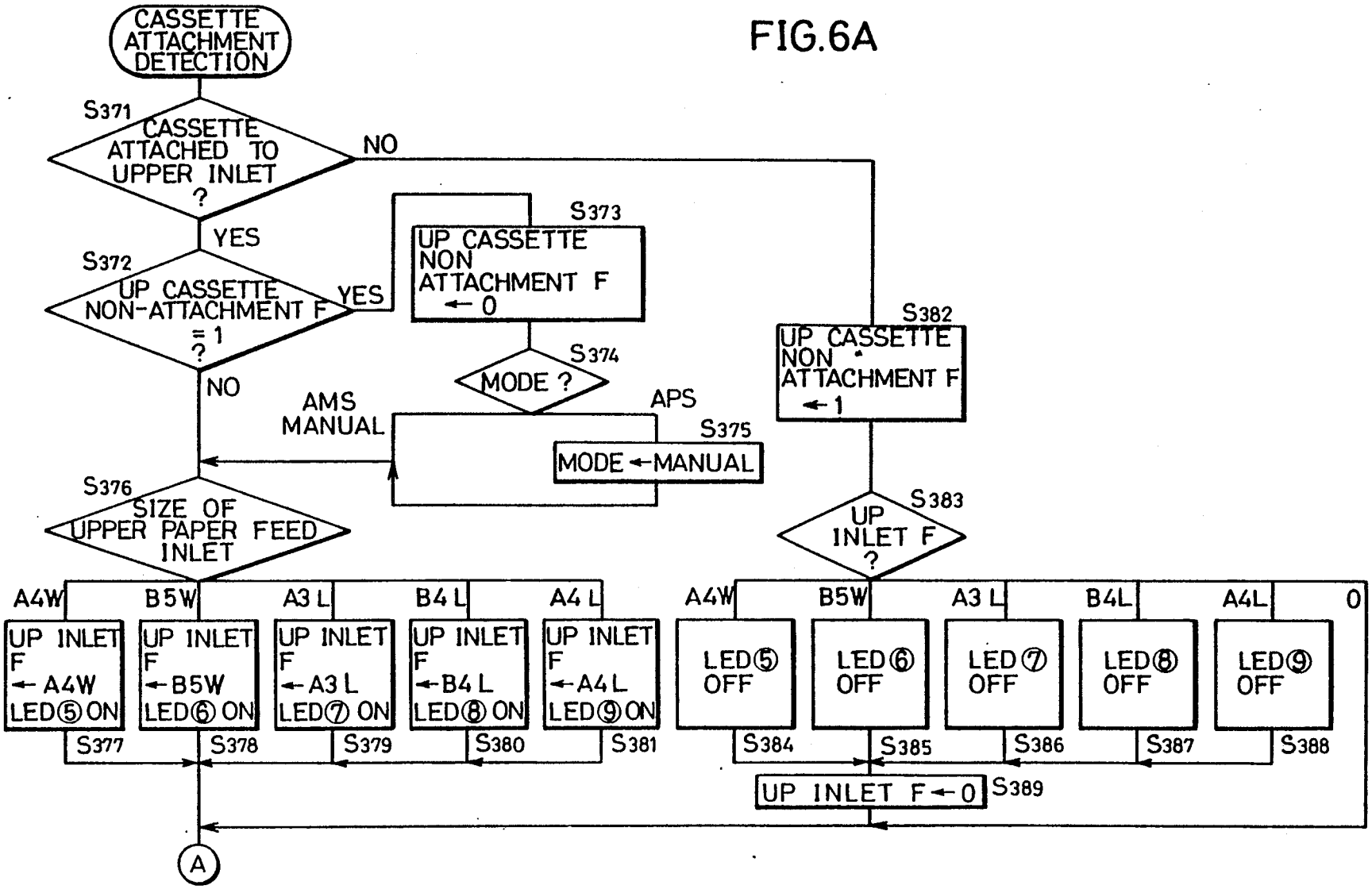
Figure 6B:
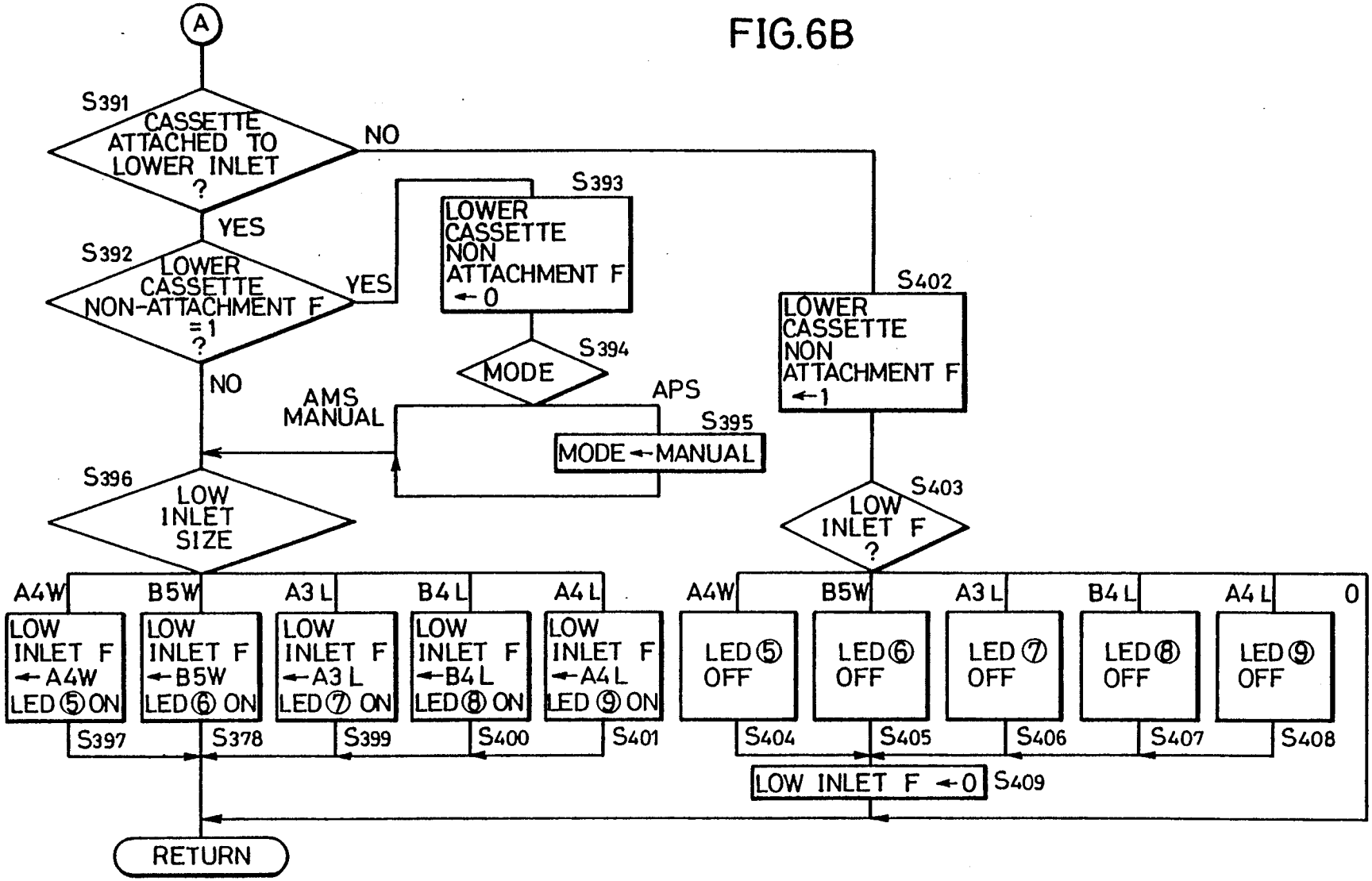

Referring to FIGS. 6A and 6B, the flow of the cassette attachment detecting routine (step S37) shown in FIG. 5 will be described. FIG. 6A shows the operation at the upper paper feeding inlet 17 while FIG. 6B shows the operation at the lower paper feeding inlet 18. First, in the step S371, whether or not the paper feeding cassette 13 is attached to the upper feeding inlet 17 is determined. If the cassette is attached (step S371; YES), whether or not the upper cassette non-attachment flag (which is set at 1 when there is no paper feeding cassette attached to the paper feeding inlet) is 1 is checked (step S372). If the upper cassette non-attachment flag is 1 (step S372; YES), then the upper cassette non-attachment flag is set to 0 (step S373) and the mode is checked (step S374). If it is the APS mode, the mode is set to the manual mode in the step S375. If it is the AMS mode or the manual mode, the mode is maintained and the flow proceeds to the next step (S376). As described above, according to the present invention, if the upper cassette non-attachment flag is 1 in S372, then the mode at that time is checked. If it is the APS mode, the mode is switched to the manual mode. Namely, if it is YES in S372, it means that the upper cassette is replaced by the user. Namely, the user desired to make copies on the sheet of paper of a particular size contained in the replaced cassette. If the APS mode is maintained in the copying machine in such case, the APS mode operates and the size of the sheet of copy paper will not be the size which the user desires. Therefore, in the present invention, when the user replaces the cassette, the APS mode is cancelled and the copying machine is set in the manual mode. Consequently, copies of the size desired by the user can be provided. The same operation is carried out for the lower cassette. When the upper cassette flag is 0 (step S372; NO), the program directly proceeds to the next step (S376). In the step S376, the size of the paper feeding cassette attached to the upper feeding inlet is detected by the cassette size detecting sensor $SE_1$. If it is A4W, then the upper paper feeding flag is set to A4W and the LED 5L is turned on (step S377). If it is B5W, then the upper paper feeding inlet flag is set to B5W and the LED 6L is turned on (step S378). If it is A3L, the upper paper feeding inlet flag is set to A3L and the LED 7L is turned on (step S379). If it is B4L, the upper paper feeding inlet flag is set to B4L and the LED 8L is turned on (step S380). If it is A4L, then the upper paper feeding inlet flag is set to A4L and the LED 9L is turned on (step S381).

Meanwhile, if there is no paper feeding cassette attached to the upper paper inlet 17 (step S371; NO), the upper cassette flag is set to 1 (step S382) and the upper paper feeding inlet flag is checked (step S383). If the upper paper feeding inlet flag is A4W, the LED 5L is turned off (step S384). If it is B5W, the LED 6L is turned off (step S385). If it is A3L, the Led 7L is turned off (step S386). If it is B4L, the LED 8L is turned off (step S387). If it is A4L, the LED 9L is turned off (step S388) and thereafter the upper paper feeding inlet flag is set to 0 (step S389). When the upper paper feeding inlet flag is 0, the program directly proceeds to the next step.

FIG. 6B is a continuation of the flow shown in FIG. 6A. In the step S391, whether or not a paper feeding cassette 14 is attached to the lower paper feeding inlet 18 is determined. If the cassette is attached (step S391; YES), then whether or not the lower cassette non-attachment flag is 1 is checked (step S392). If the lower cassette non-attachment flag is 1 (step S392; YES), the lower cassette non-attachment flag is set to 0 (step S393) and the mode is checked (step S394). If it is the APS mode, then the mode is changed to the manual mode (step S395). If it is the AMS mode or the manual mode, the mode is maintained and the program proceeds to the next step (step S396). When the lower cassette non-attachment flag is 0 (step S392; NO), the program directly proceeds to the next step (step S396). In the step S396, the size of the paper feeding cassette attached to the lower paper feeding inlet 18 is detected by the cassette size detecting sensor $SE_2$. If the size of the paper feeding cassette is A4W, then the lower paper feeding inlet flag is set to A4W and the LED 5L is turned on (step S397). If it is B5W, the lower paper feeding inlet flag is set to B5W and the LED 6L is turned on (step S398). If it is A3L, the lower paper feeding inlet flag is set to A3L and the LED (7) is turned on (step S399). If it is B4L, the lower paper feeding inlet flag is set to B4L and the Led (8) is turned on (step S400). If it is A4L, the lower paper feeding inlet flag is set to A4L and the LED (9) is turned on (step S401).

Meanwhile, when there is no paper feeding cassette attached to the lower paper feeding inlet 18 (step S391; NO), the lower cassette non-attachment flag is set to 1 (step S402) and the lower paper feeding inlet flag is checked (step S403). If the lower paper feeding inlet flag is A4W, the LED 5L is turned off (step S404). If it is B5W, the LED 6L is turned off (step S405). If it is A3L, the LED 7L is turned off (step S406). If it is B4L, the LED 8L is turned off (step S407). If it is A4L, the LED 9L is turned off (step S409) and thereafter the lower paper feeding inlet flag is set to 0 (step S409). If the lower paper feeding inlet flag is 0, then the program directly returns to the main flow.

As described above, in the cassette attachment detecting routine of the step S37, the size of the paper feeding cassettes attached to the upper and lower paper feeding inlets 17 and 18 are detected, and the turning ON/OFF of the LEDs 5L to 9L are controlled corresponding to the result of detection. For example, if the paper feeding cassette of the size A4L is attached to the upper paper feeding inlet 17 and the paper feeding cassette of A4W is attached to the lower paper feeding inlet 18, then LEDs 5L and 6L are on. When a paper cassette is removed, the LED corresponding to the removed paper feeding cassette is turned off.

Figure 7:
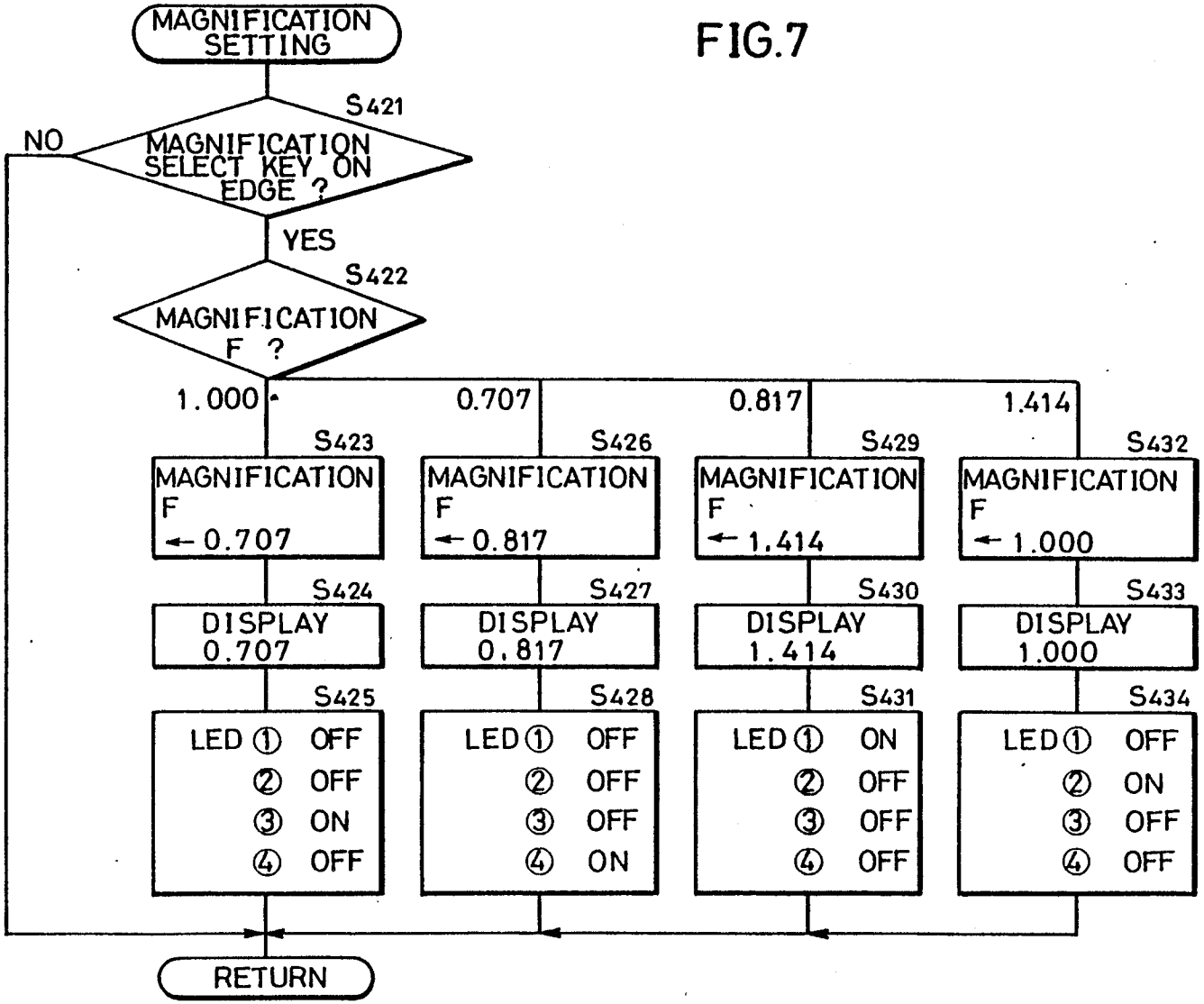

The flowchart showing the content of the magnification setting routine (step S42) of FIG. 5 will be described in the following with reference to FIG. 7. In the step S421, whether or not there is an ON edge of the magnification selection key 37 is determined. If there is the ON edge (step S421; YES), the present magnification flag is checked (step S422). If the magnification flag is 1.000, then the magnification flag is set to 0.707 (step S423), the numeral 0.707 is displayed on the magnification displaying portion 35 (step S424) and only the LED 3L is turned on (step S425). When the magnification flag is 0.707, then the magnification flag is set to 0.817 (step S426), the numeral 0.817 is displayed on the magnification displaying portion 35 (step S427) and only the LED 4L is turned on (step S428). If the magnification flag is 0.817, the magnification flag is set to 1.414 (step S429), the numeral 1.414 is displayed on the magnification displaying portion 35 (step S430) and only the LED 1L is turned on (step S431). If the magnification flag is 1.414, then the magnification flag is set to 1.000 (step S432), the numeral 1.000 is displayed on the magnification displaying portion 35 (step S433) and only the LED 2L is turned on (step S434). If there is no ON edge of the magnification selection key 37 (step S421; NO), the program directly returns to the main flow.

In the above described manner, the desired magnification can be set by the magnification selection key.

Figure 8:
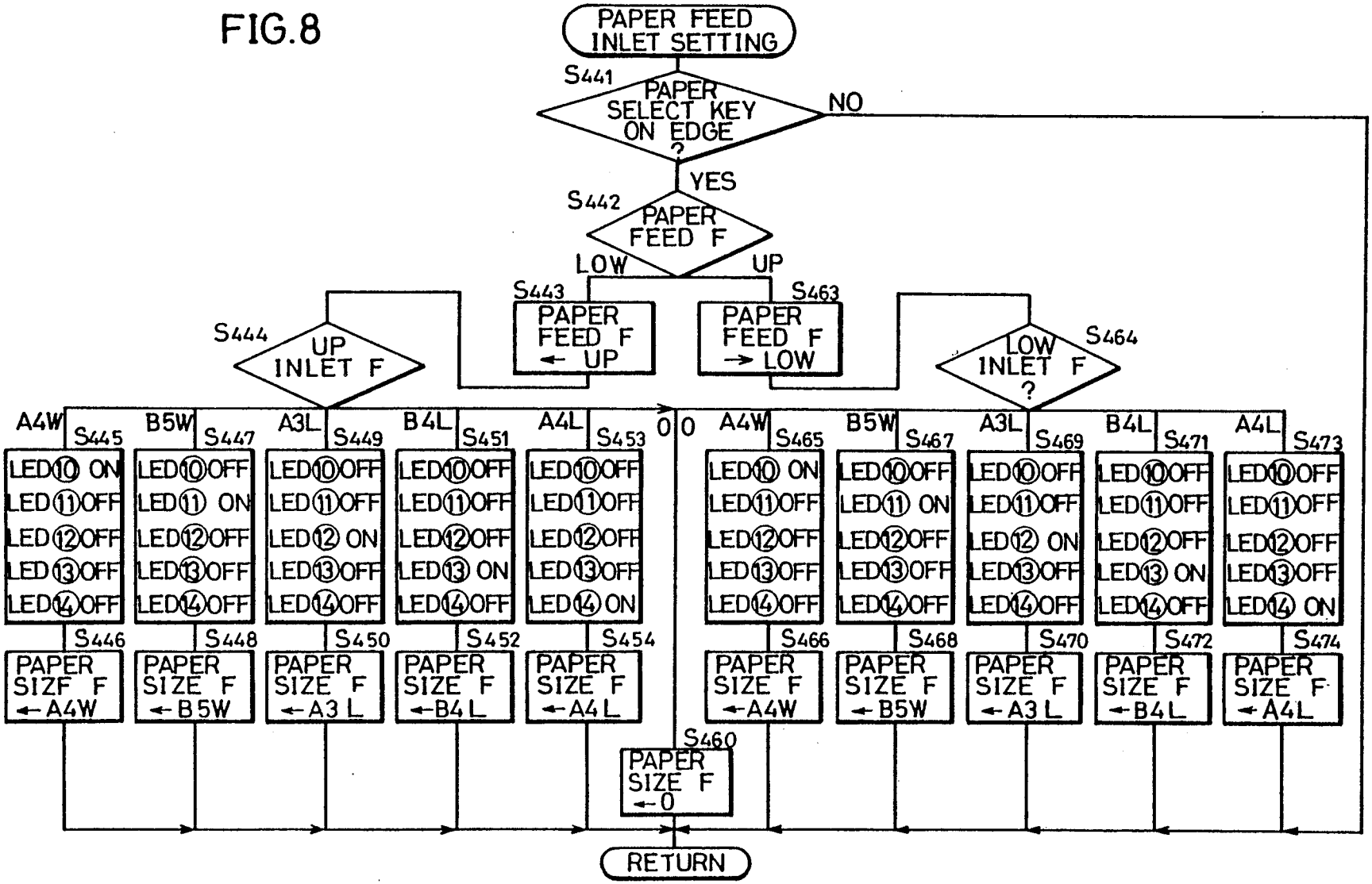

The flowchart showing the content of the paper feed inlet setting routine (step S44) of FIG. 5 will be described in the following with reference to FIG. 8. In the step S441, whether or not there is an ON edge of the paper selection key 36 is determined. If there is the ON edge (S441; YES), the present paper feeding flag (flag indicating which one of the upper and lower paper feeding inlets is used for actual paper feeding) is checked (step S442). When the paper feeding flag indicates the lower inlet, the paper feeding flag is set to indicate the upper inlet (step S443), and the state of the upper paper feeding inlet flag (see FIG. 6A) is checked (step S444). If the upper paper feeding inlet flag indicates A4W, only the LED 10L is turned on (step S445), the paper feeding size flag (flag indicating the size of the paper feeding cassette attached to the selected paper feeding inlet) is set to A4W (step S446). If the upper paper feeding inlet flag indicates B5W, only the LED 11L is turned on (step S447) and the paper feeding size flag is set to B5W (step S448). If the upper paper feeding inlet flag is A3L, only the LED 12L is turned on (step S449) and the paper feeding size flag is set to A3L (step S450). If the upper paper feeding inlet flag is B4L, only the LED 13L is turned on (step S451) and the paper feeding size flag is set to B4L (step S452). If the upper paper feeding inlet flag is A4L, only the LED 14L is turned on (step S453), and the paper feeding size flag is set to A4L (step S454). If the upper paper feeding inlet flag is 0, then the paper feeding size flag is set to 0 (step S460).

Meanwhile, if the present paper feeding flag indicates the upper inlet, the paper feeding flag is set to indicate the lower one (step S463) and the state of the lower paper feeding inlet flag (see FIG. 6B) is checked (step S464). If the lower paper feeding inlet flag indicates A4W, only the LED 10L is turned on (step S465) and the paper feeding size flag is set to A4W (step S466). If it is B5W, only the LED 11L is turned on (step S467) and the paper feeding size flag is set to B5W (step S468). If it is A3L, only the LED 12L is turned on (step S469) and the paper feeding size flag is set to A4L (step S470). If it is B4L, only the LED 13L is turned on (step S471), and the paper feeding size flag is set to B4L (step S472). If it is A4L, only the LED 14L is turned on (step S473) and the paper feeding size flag is set to A4L (step S474). If the upper paper feeding inlet flag is 0, then the paper feeding size flag is set to 0 (step S460).

When there is no ON edge of the paper selection key (step S441; NO), the program directly returns to the main flow.

The flowchart showing the content of the copying operation routine (S5) of FIG. 4 will be described in the following with reference to FIG. 9. In the step S51, whether or not there is an ON edge of the print key 31 is determined. If there is an ON edge (step S51; YES), the present mode is checked (step S52). If the present mode is the APS mode, then the size of the original is detected by the original size detecting sensor $SE_3$ (step S53), the paper feeding size is calculated (step S54), and thereafter the program proceeds to the next step (S58). If it is the AMS mode, the size of the original is detected (step S55), the magnification is calculated (step S56) and, thereafter, the program proceeds to the next step (S58). If it is the manual mode, the warning flag is set to 0 (step S57) and the program proceeds to the next step (S58).

In the step S58, whether or not the warning flag is 1 is determined. If it is 0 (step S58; NO), the magnification changing motor M is moved in accordance with the magnification flag (step S59). The copy paper is fed from the paper feeding inlet indicated by the paper feeding flag (S60), and actual copying operation including scanning by the optical system 10, exposure, development and fixing is carried out (step S61). The steps S60 and S61 are repeated until the set number of copies are completed (step S62). If the warning flag is 1 (step S58; YES), a warning process is carried out (step S63), and the program returns to the main flow.

If there is no ON edge of the print key 31 (step S51; NO), the program directly returns to the main flow.

The flowchart showing the content of the paper feed size calculating routine (S54) of FIG. 9 will be described in the following with reference to FIG. 10. In the step S541, the paper feeding size flag and the warning flag are set in accordance with the following Table 1. An LED corresponding to the set paper feeding size flag is selected from the LEDs 10L to 14L to be turned on. The LEDs which do not correspond the paper feeding size flag are turned off.

| | ORIGINAL SIZE | | | | |
|---|---|---|---|---|---|
| MAGNIFICATION | A3L | B4L | A4L | A4W | B5W |
| 1.414 | 0 | 0 | 0 | 0 | 0 |

-continued

| MAGNIFICATION | ORIGINAL SIZE | | | | |
|---|---|---|---|---|---|
| | A3L | B4L | A4L | A4W | B5W |
| | 1 | 1 | 1 | 1 | 1 |
| 1.000 | A3L | B4L | A4L | A4W | B5W |
| | 0 | 0 | 0 | 0 | 0 |
| 0.817 | B4L | A4L | 0 | B5W | 0 |
| | 0 | 0 | 1 | 0 | 1 |
| 0.707 | A4L | 0 | 0 | 0 | 0 |
| | 0 | 1 | 1 | 1 | 1 |

In the respective rows corresponding to the magnification in table 1, the upper portion shows the paper feeding size flag and the lower portion shows the warning flag.

In the step S542, whether or not the warning flag is 1 is determined. When the warning flag is 0 (step S542; NO), whether or not the upper paper feeding inlet flag and the paper feeding size flag coincide with each other is checked (step S543). If the two flags match with each other (step S543; YES), the paper feeding flag is set to the upper one (step S544), and otherwise (step S544; NO), whether or not the lower paper feeding inlet flag and the paper feeding size flag coincide with each other is checked (step S545). When the two flags coincide with each other (step S545; YES), the paper feeding flag is set to the lower one (step S546) and otherwise (step S543; NO), the warning flag is set to 1 (step S547). If the warning flag is 1 in the step S542 (step S542; YES), the program directly returns to the main flow.

Figure 9:
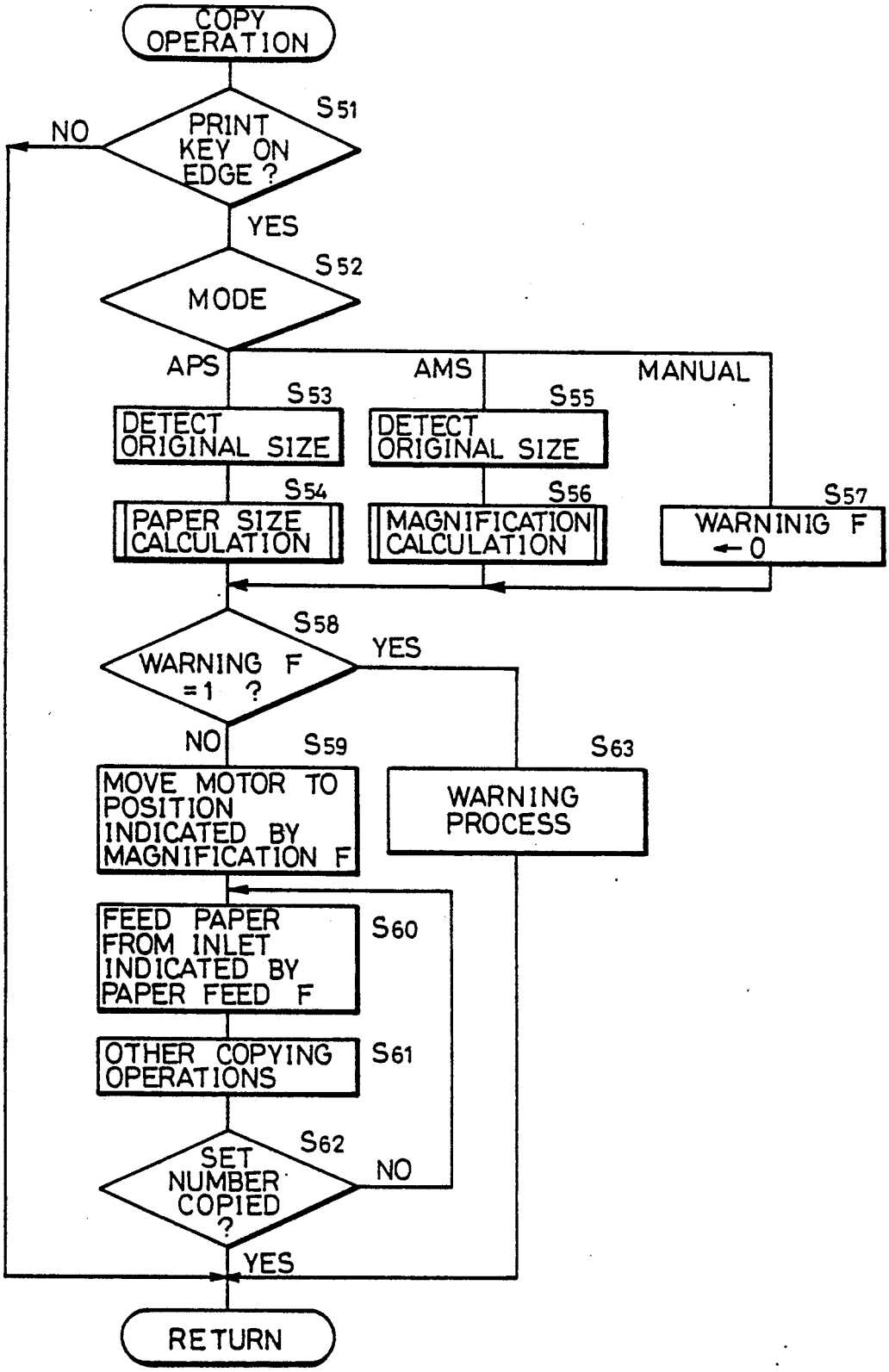
Figure 10:
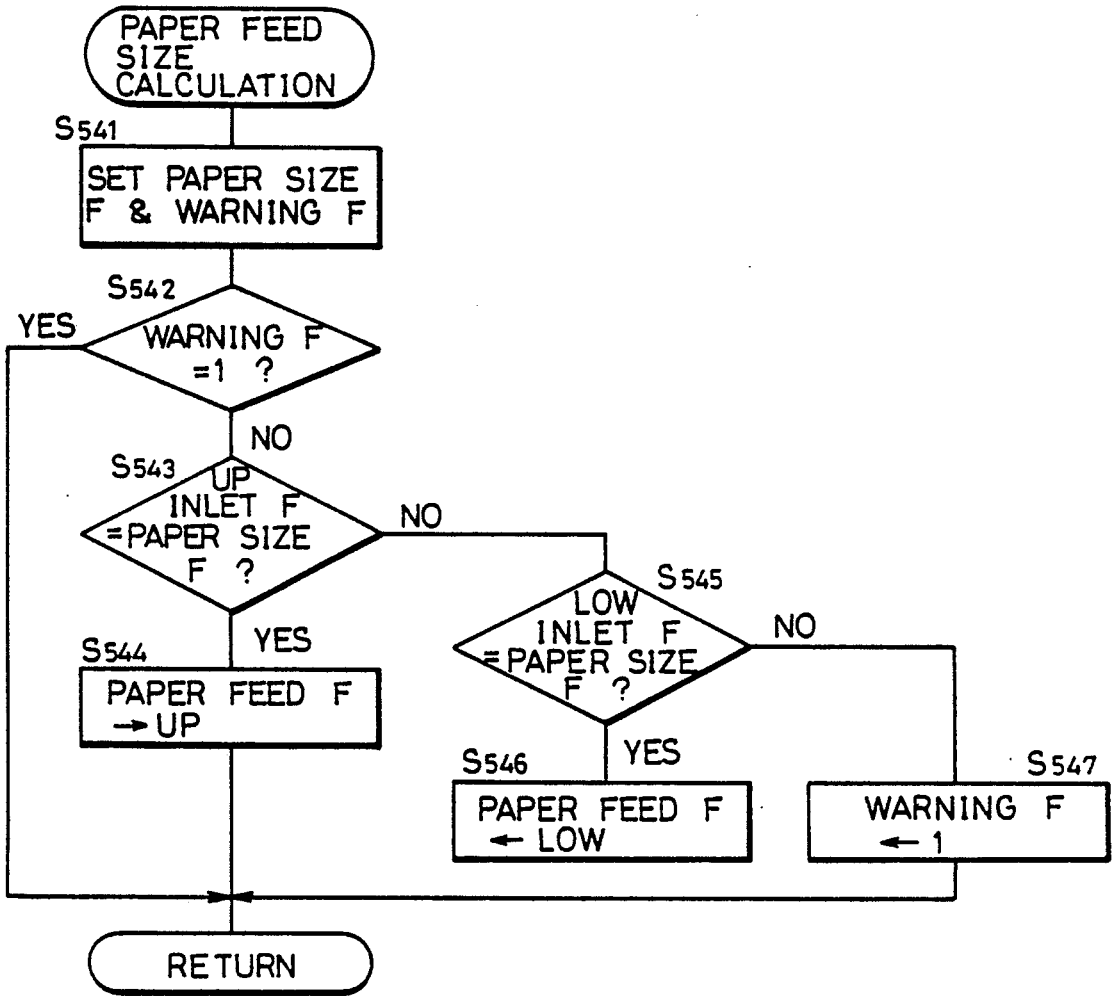
Figure 11:
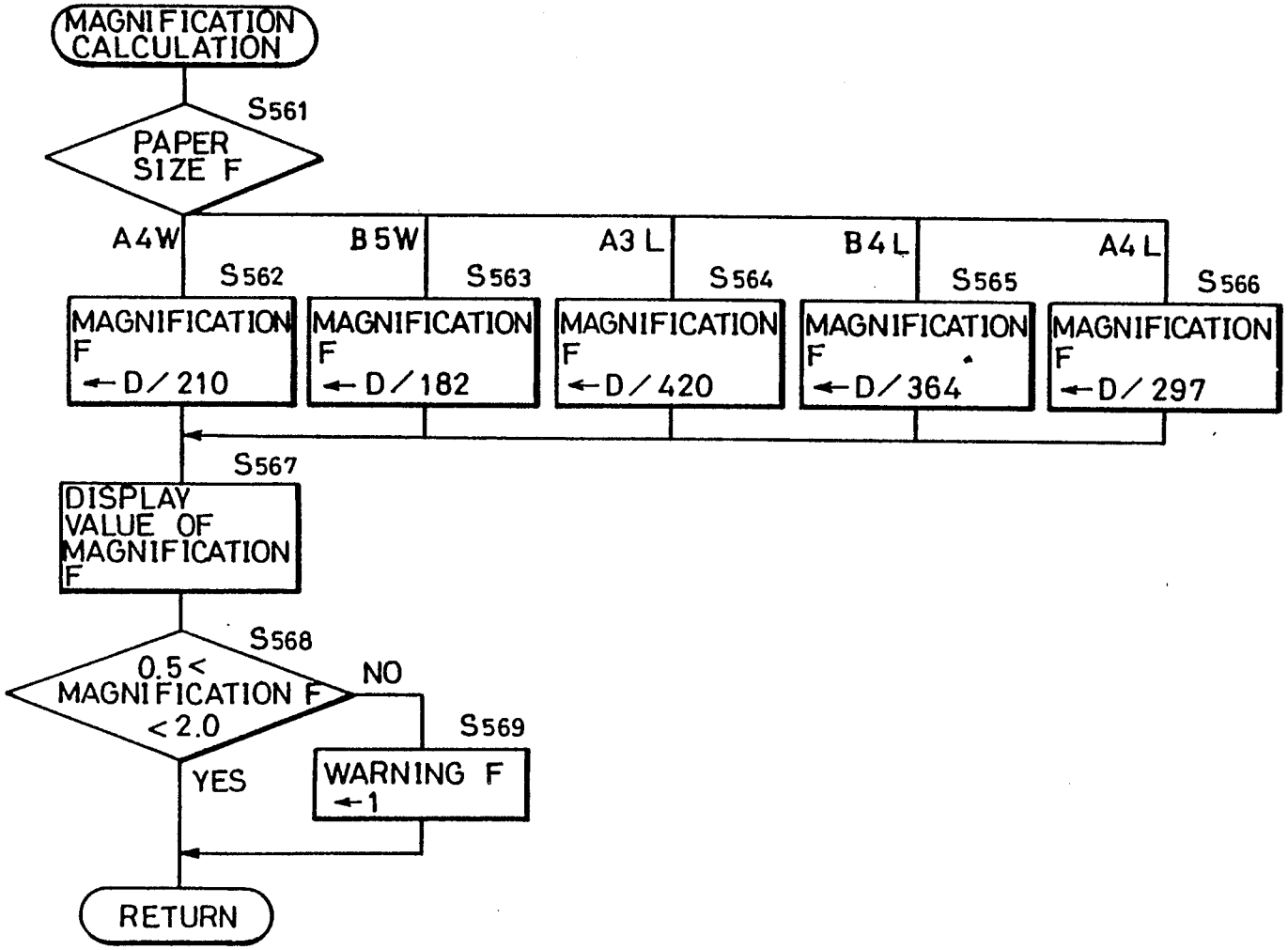

FIG. 11 is a flowchart showing the content of the magnification calculating routine (step S56) shown in FIG. 9. In the step S561, the paper feeding size flag is checked and the values calculated based on the following equations (1) to (5) are used as the magnification flags corresponding to the respective paper feeding size flags. Namely, when the paper feeding size flag is A4W, then D/210 . . . (1) (step S562)
B5W, then D/182 . . . (2) (step S563)
A3L, then D/420 . . . (3) (step S564)
B4L, then D/364 . . . (4) (step S565)
A4L, then D/297 . . . (5) (step S566), where D represents the length of the original, which is detected by the above described original size detecting sensor $SE_3$.

Thereafter, the calculated value of the magnification flag is displayed on the magnification displaying portion 35 (step S567). If the value of the magnification flag is in the range from 0.5 to 2.0 (step S568; YES), the program directly returns to the main flow and, otherwise (step S568; NO), the warning flag is set to 1 (step S569) and thereafter the program returns to the main flow.

II. Second Embodiment

Figure 12:
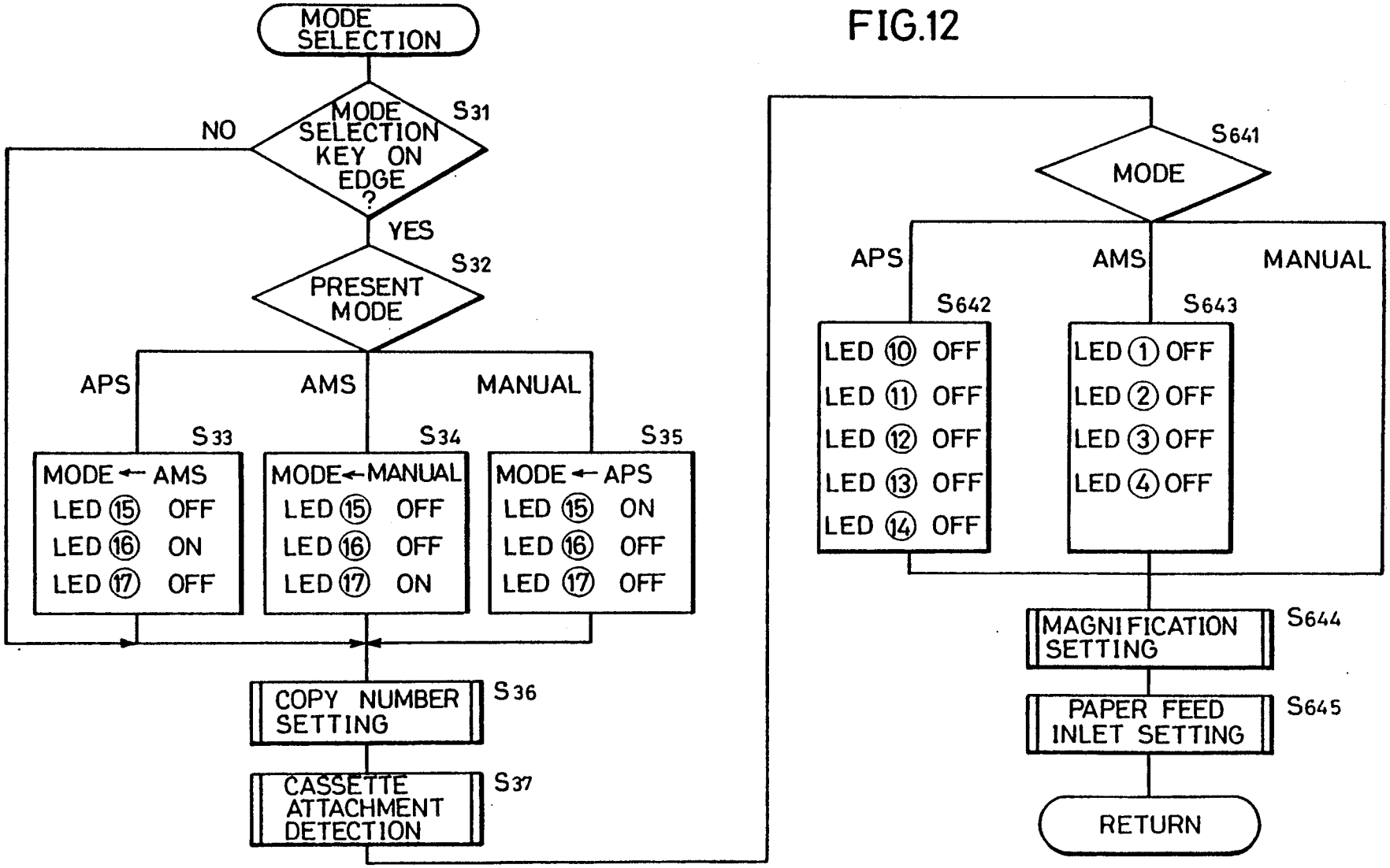
FIG. 12 is a flowchart showing a second embodiment of some of the subroutines.

The second embodiment of the present invention is similar to the first embodiment except for the mode selection routine and, therefore, only portion different from the first embodiment will be described in the following with reference to FIG. 12. FIG. 12 corresponds to FIG. 5 of the first embodiment. In the second embodiment of the present invention, when the copying machine is in the APS mode at the time of mode determination (S641), then the LEDs 10L to 14L are kept off (S642). Namely, when the APS mode is set, the size of the copy paper to be selected is not displayed on the operation panel 30. When the AMS mode is set, the LEDs 1L to 4L are kept off (S643). Namely, when the AMS mode is set, the magnification to be selected is not displayed on the operation panel 30. Therefore, the user cannot select either the size of the copy paper or the magnification. Consequently, the user does not select the desired size of copy paper or the magnification when the APS mode or the AMS mode is selected, whereby the erroneous operation by the user can be prevented.

Since other steps are similar to those of the first embodiment, the explanation of those are omitted.

III. Third Embodiment

Figure 13:
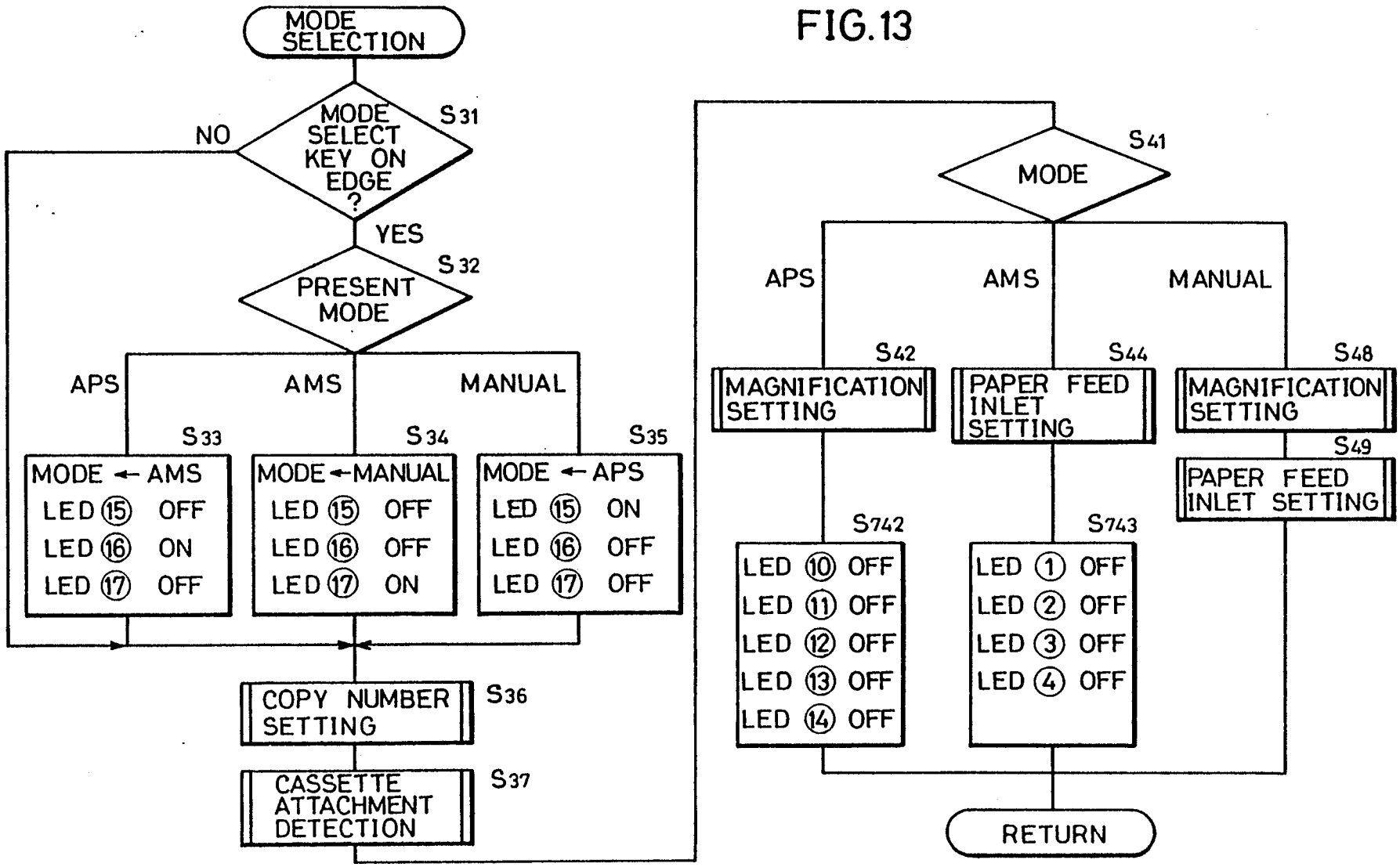
FIG. 13 is a flowchart showing a third embodiment of some of the subroutines.

The third embodiment of the present invention is a combination of the first embodiment and the second embodiment. FIG. 13 is a flowchart showing the third embodiment of the present invention. As shown in FIG. 13, when the APS is set, only magnification setting is possible and LEDs for selecting paper feeding inlet are turned off. Therefore, the user cannot set the paper feeding inlet.

When the AMS mode is set, on the contrary, only paper feeding inlet can be selected.

IV. The Fourth Embodiment

Figure 14A:
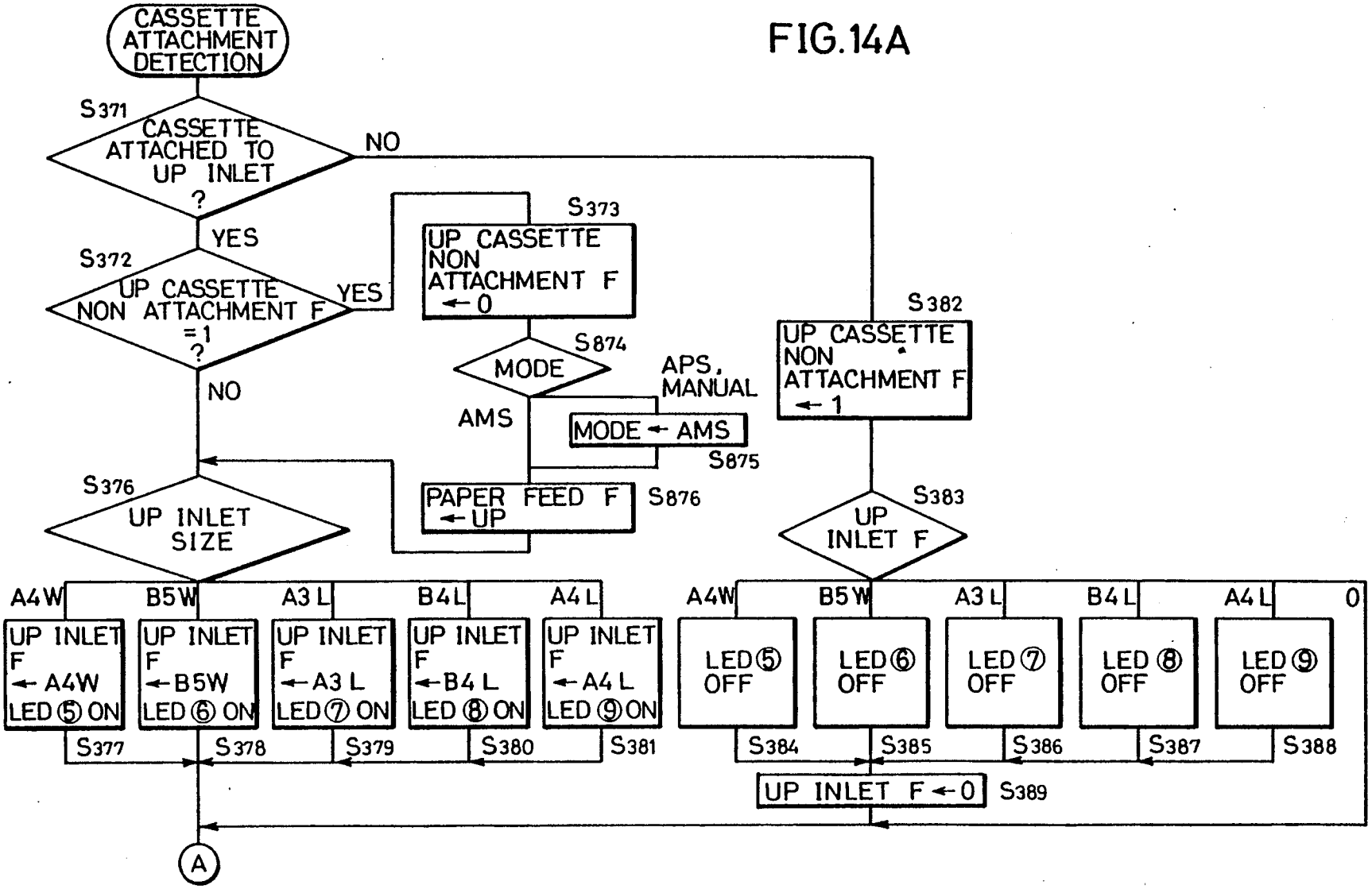
FIGS. 14A and 14B are flowcharts showing a fourth embodiment of some of the subroutines.
Figure 14B:
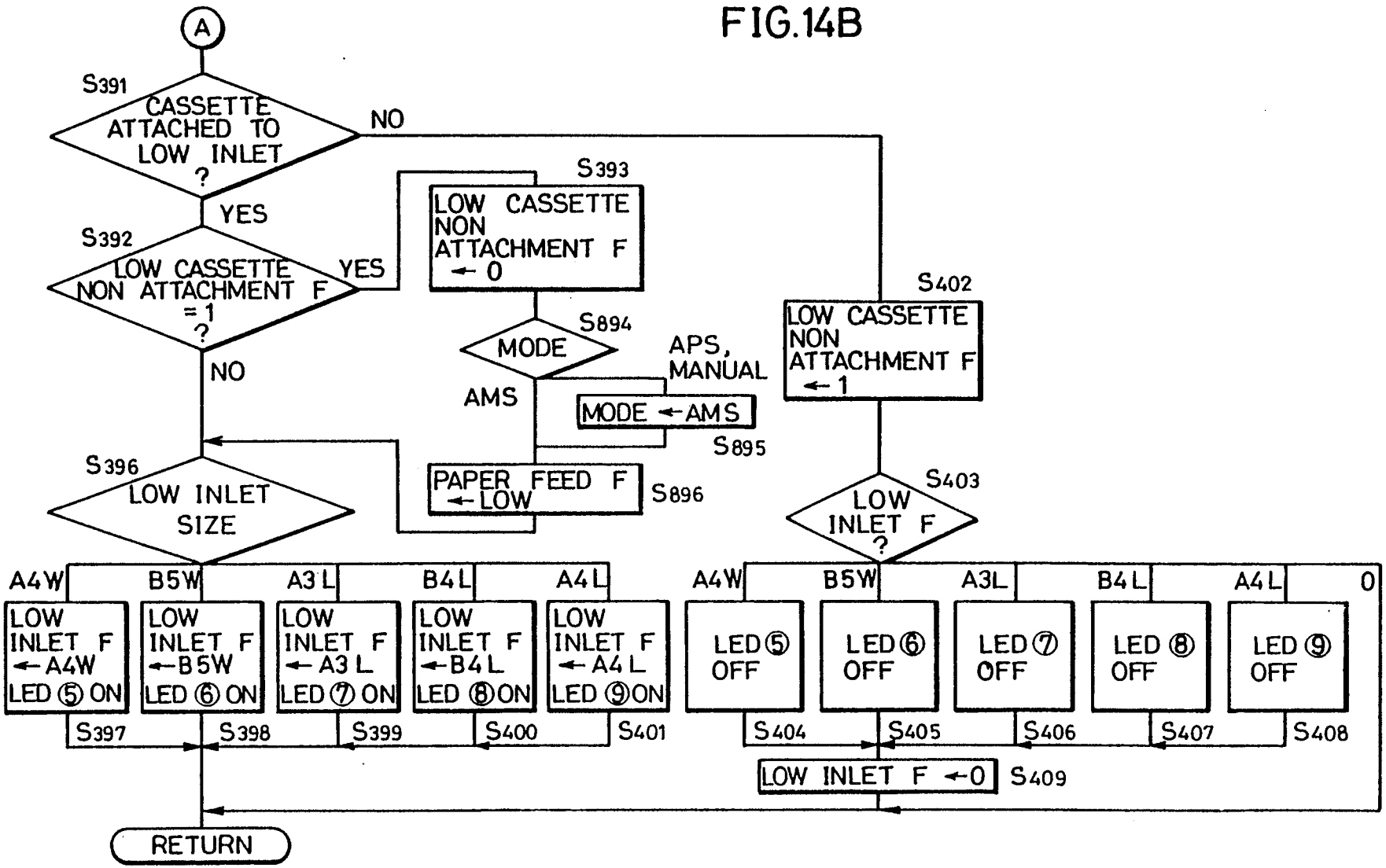

The fourth embodiment of the present invention is also similar to the first embodiment except for the cassette attachment detection routine, so that this subroutine will be described with reference to FIGS. 14A and 14B instead of FIG. 6A and 6B of the first embodiment.

In the fourth embodiment, the AMS mode is set at S875 or S895 when either the APS mode or the manual mode is detected at S874 or S894, that is, when the cassette is replaced, the mode is automatically switched from the APS Mode or the manual mode to the AMS mode and the desired cassette is selected (S876, S896).

In this case, if the user replaces the cassette to use another size of paper, the copy machine automatically switches the mode to the AMS mode so as to execute the copying operation with the replaced cassette accommodating the paper of the desired size.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying machine for copying an image of an original on a sheet of paper, comprising:

mode setting means for setting a mode for automatically selecting size of said paper based on size of said original and a copying magnification;

manual paper setting means for manually setting said size of paper; and means for inhibiting setting of the size of the paper by said manual paper setting means when said automatic paper selecting mode is set in said copying machine.

2. A copying machine according to claim 1, further comprising:

original size detecting means for detecting the size of said original; and magnification input means for inputting said copying magnification.

3. A copying machine according to claim 2, wherein said manual paper setting means comprises input means for inputting said paper size, and said inhibiting means inhibits input of said paper size from said input means.

4. A copying machine according to claim 2, further comprising displaying means for displaying the set paper size, wherein said inhibiting means inhibits display on the displaying means of the paper size set by said manual paper setting means.

5. A copying machine according to claim 3, wherein said mode setting means comprises paper size calculating means for calculating a desired paper size based on said original size and the copying magnification.

6. A copying machine according to claim 5, wherein said copying machine includes image forming means for copying the image of said original on said paper and paper feeding means for feeding said paper to said image forming means, said copying machine further comprising:

warning means for warning when said desired paper size calculated by said paper size calculating means is different from the size of the paper fed by said paper feeding means.

7. A copying machine for copying an image of an original on a sheet of paper, comprising:

mode setting means for setting a mode for automatically selecting size of said paper based on the size of said original and copying magnification;

a plurality of paper feeding cassettes detachably mounted on said copying machine for feeding said paper; and controlling means for controlling said copying machine such that said automatic paper selecting mode is cancelled when said paper feeding cassette is attached to said copying machine.

8. A copying machine according to claim 7, further comprising:

automatic magnification setting means for setting a mode for automatically selecting magnification based on the size of said original and the size of said paper; wherein said controlling means sets said automatic magnification selecting mode after said automatic paper selecting mode is cancelled.

9. A copying machine for copying an image of an original on a sheet of paper, comprising:

mode setting means for setting a mode for automatically selecting copying magnification based on the size of said original and the size of paper;

a plurality of paper feeding cassettes detachably provided on said copying machine for feeding said paper; and controlling means for automatically setting said automatic magnification selecting mode when said paper feeding cassette is attached to said copying machine.

10. A copying machine for copying an image of an original on a sheet of paper, comprising:

original size detecting means for detecting the size of said original;

magnification input means for inputting said copying magnification, calculating means for calculating a desired paper size based on the original size and the copying magnification;

paper size input means for inputting the size of paper;

means for selecting a first mode for automatically setting a size of said paper based on a data of said calculating means and a second mode for setting the size of said paper based on the input of said paper size input means; and means for inhibiting input of the size of the paper by said paper size input means when said first mode is selected.

11. A copying machine according to claim 10, wherein said inhibiting means cancels the input of said paper size.

12. A copying machine according to claim 10, further comprising displaying means for displaying the size input by paper size input means, wherein said inhibiting means inhibits display on the displaying means when said first mode for automatically determining the size of said paper is selected.

13. A copying machine for copying an image of an original on a sheet of paper, comprising:

original size detecting means for detecting a size of said original;

magnification input means for inputting a copying magnification, paper size input means for inputting a size of paper;

means for selecting a mode for automatically determining the size of said paper based on the size of said original detected by said original size detecting means and the copying magnification input by said magnification input means; and control means for cancelling said mode when the cassette is replaced to the copying machine and automatically determining the copying magnification based on the size of said original detected by said original size detecting means and the size of paper accommodated in the cassette which is mounted latest on the copying machine.

14. A copying machine for copying an image of an original on a sheet of paper, comprising:

paper supplying means for supplying the paper on which a paper cassette is detachably mounted;

magnification input means for inputting a copying magnification;

means for selecting a first mode for automatically determining the copying magnification based on the size of the original and the size of the paper and a second mode for determining the copying magnification based on the input of said magnification input means; and controlling means when said feeding cassette is attached on said paper supplying means, for automatically determining the copying magnification based on the size of said original and the size of paper accommodated in said mounted cassette.

* * * * *

UNITED STATES PATENT AND TRADEMARK OFFICE

CERTIFICATE OF CORRECTION

PATENT NO. : 5,065,198

DATED : November 12, 1991

INVENTOR(S) : Toshiyuki YAMASHITA, et al.

It is certified that error appears in the above-identified patent and that said Letters Patent is hereby corrected as shown below:

ON THE TITLE PAGE: Also col. 1, line 5;

[54] COPYING APPARATUS HAVING MEANS FOR INHIBITING MANUAL SETTING OF PAPER SIZE AND MAGNIFICATION WHEN THE AUTOMATIC PAPER SELECTION MODE AND AUTOMATIC MAGNIFICATION SELECTION MODE ARE SET

Signed and Sealed this

Second Day of March, 1993

*Attest:*

STEPHEN G. KUNIN

*Attesting Officer*

*Acting Commissioner of Patents and Trademarks*